United States Patent [19]

Harbin

[11] 4,313,238

[45] Feb. 2, 1982

[54] SHOE CLEANING MACHINE

[75] Inventor: Charles M. Harbin, Wooster, Ohio

[73] Assignee: AMCS Corporation, Wooster, Ohio

[21] Appl. No.: 128,530

[22] Filed: Mar. 10, 1980

[51] Int. Cl.[3] ..... A47L 23/22

[52] U.S. Cl. ..... 15/37

[58] Field of Search ..... 15/36, 37, 311, 179, 15/181

[56] References Cited

U.S. PATENT DOCUMENTS

| | | | |
|---|---|---|---|
| 732,373 | 6/1903 | Preuss | 15/36 |
| 1,359,193 | 11/1920 | Parker | 15/36 X |
| 2,647,271 | 8/1953 | Ryzenga | 15/37 |
| 3,120,018 | 2/1964 | Lanstrom | 15/179 |
| 3,802,021 | 4/1974 | Schulz | 15/36 |
| 3,846,861 | 11/1974 | Smith, Jr. | 15/181 X |

*Primary Examiner*—Edward L. Roberts

*Attorney, Agent, or Firm*—Hamilton, Renner & Kenner

[57] ABSTRACT

A shoe cleaning machine having a housing (10,11) and a grid frame (12) within the housing, transversely spaced longitudinal channels (47) presenting flat co-planar upper surfaces, longitudinal rows of brush bristles (B) having curved sections projecting tangentially between said channels, said sections being detachably mounted on transversely extending bars (33) journaled in the housing and oscillatable by a linkage (54,55,56) driven by a motor (59).

11 Claims, 8 Drawing Figures

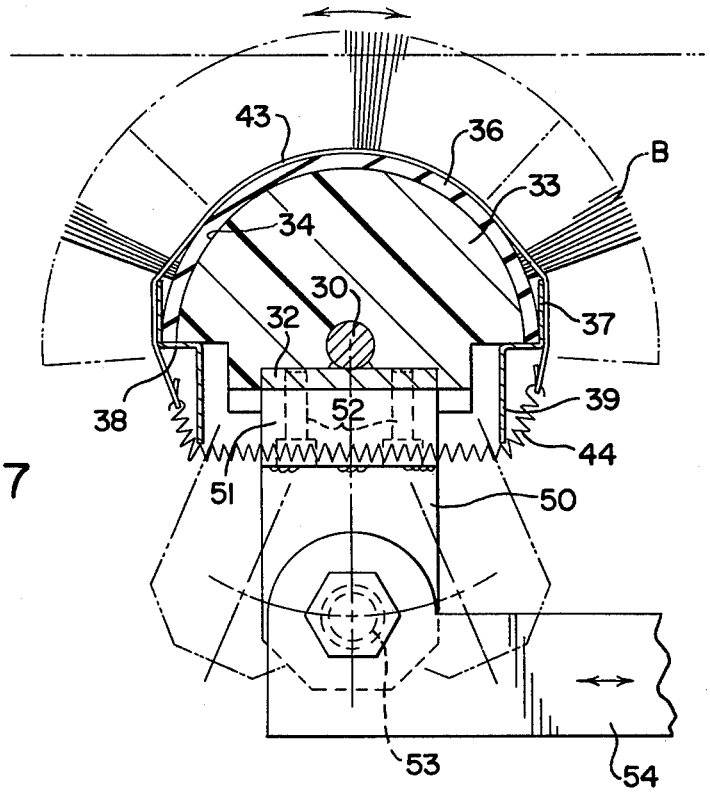
FIG. 7
FIG. 8
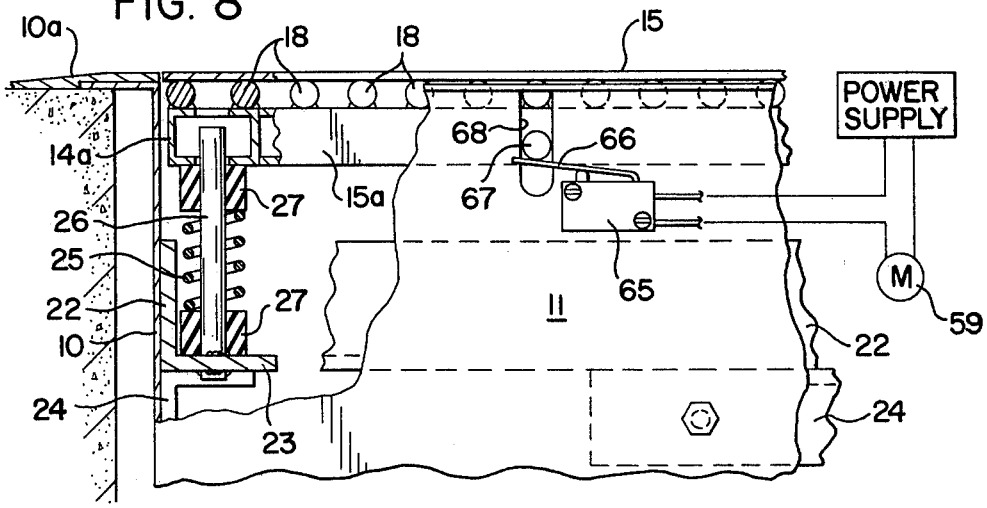

SHOE CLEANING MACHINE

TECHNICAL FIELD

The invention relates to shoe cleaning devices which are embedded in the floor at the entrance to residences, public buildings and institutions, and transportation vehicles such as buses, and which automatically clean and brush the shoes of a person stepping onto the machine.

BACKGROUND ART

Various prior devices have been proposed for cleaning the shoes of a person stepping or standing on the device at the entrance to a building, and all such devices of which I am aware have had certain disadvantages in respect to the construction and movement of the brush elements that perform the cleaning, and the construction and arrangement of the plate elements which surround the brushes and support the weight of the person stepping onto the machine.

U.S. Pat. No. 2,647,241 shows a mechanical floor mat having an open grid formed by spaced metal strips between which rows of bristle tufts are reciprocated by rack and pinion means to provide the cleaning action. The bristle tufts are described as secured in recesses in the metal shafts, which would not be a satisfactory or durable construction as the tufts would tend to come loose in continued use. Furthermore, if any of the bristle tufts become worn or fall out, the entire bar must be replaced. Moreover, the narrow strips forming the grid are widely spaced apart, as are the bristle tufts, so that a person standing on the grid does not have a stable support, particularly when wearing the high narrow heels prevalent in women's shoes.

These same disadvantages, together with others, are present in the shoe cleaning devices of prior U.S. Pat. Nos. 2,649,599 and 3,029,452. Other known prior devices have banks of bristles which are reciprocated in a horizontal plane while contacting the entire surfaces of the shoe soles of a person standing or stepping thereon, thereby providing an extremely unstable support.

DISCLOSURE OF THE INVENTION

The present shoe cleaning machine provides a construction having a brush and grid arrangement which provides a stable support for persons standing or stepping thereon, including persons wearing narrow or high heels, and has a durable, easily detachable brush mounting construction.

An object of the present invention is to provide an improved grid having a non-skid surface, with the spaces between the protruding brush bristles entirely enclosed and presenting flat horizontal surfaces.

Another object is to provide improved means for mounting rows of brush bristles on oscillatable shafts to produce a tangential sweeping action on the shoes of a person standing thereon.

A further and more specific object is to provide improved flexible strips in which the bristles are permanently secured by molding, the strips being detachably wrapped around enlarged curved plastic shaft portions, so that the strips can be individually replaced without detaching the shaft portions.

A still further object is to provide an improved shoe cleaning machine which is strong and compact, which operates smoothly without materially affecting the stability of a person supported thereon, and which overcomes the disadvantages of known prior shoe cleaning devices.

These and other objects are accomplished by the improvements comprising the present invention disclosed herein by way of example, as comprising a preferred manner of carrying out the invention. Various modifications and changes in details of construction are comprehended within the appended claims.

BRIEF DESCRIPTION OF DRAWINGS

FIG. 7 is an enlarged partial sectional view on line 7—7 of FIG. 4.

FIG. 8 is an enlarged partial sectional view on line 8—8 of FIG. 3.

PREFERRED EMBODIMENT OF THE INVENTION

Figure 1:
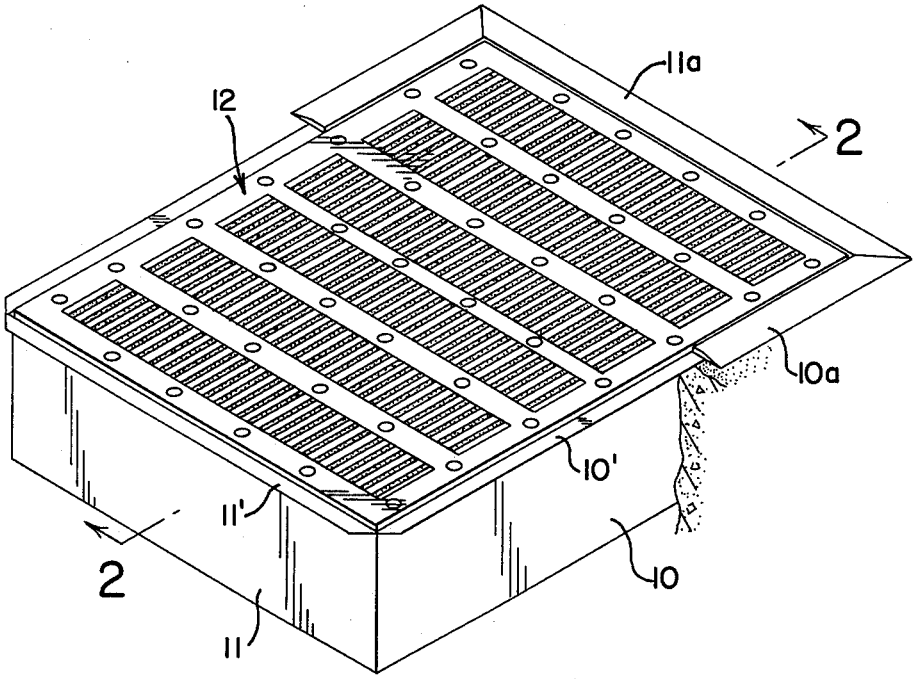
FIG. 1 is a perspective view, partly broken away, of the improved shoe cleaning machine embodying my invention.

The improved machine as shown in FIG. 1 comprises a rectangular housing having side walls 10 and end walls 11 and supporting a grid or grating, indicated generally at 12, within their upper edges. Preferably, the walls 10 and 11 have outturned flanges 10' and 11' at their upper edges and mitered molding strips **10*a* and 11*a*** overlie and are adhered to said flanges.

Figure 2:
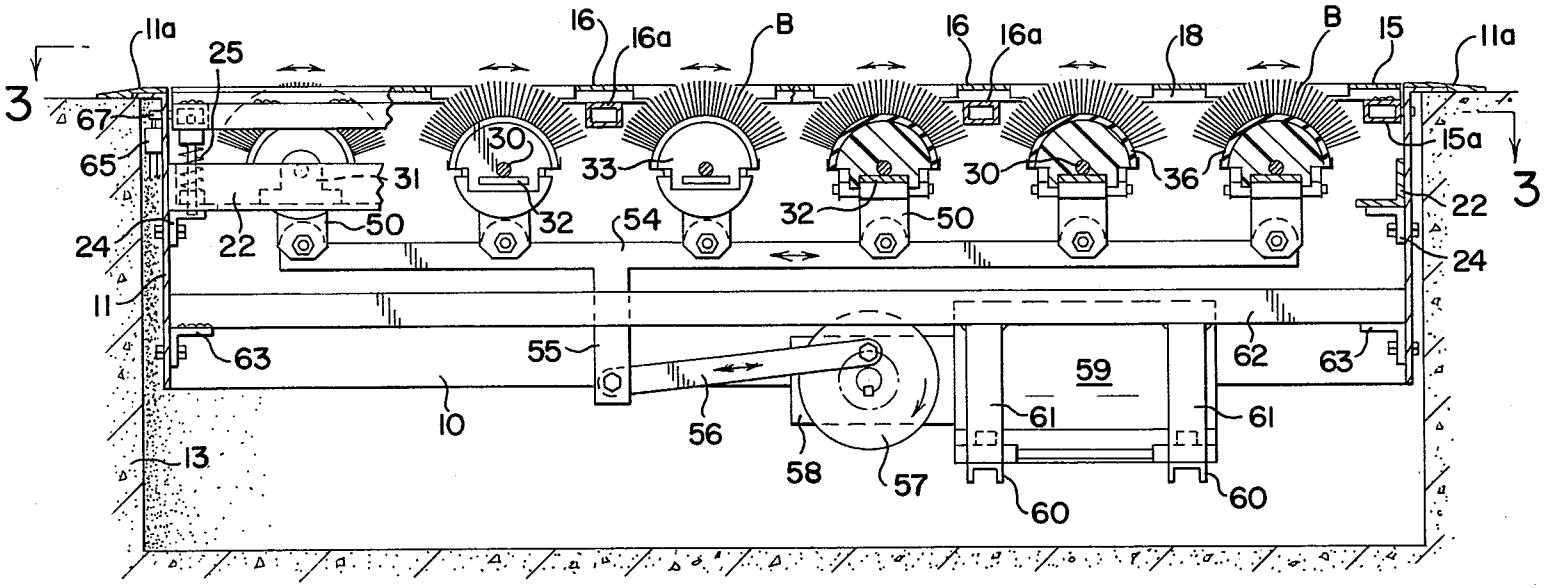
FIG. 2 is an enlarged sectional view on line 2—2 of FIG. 1.
Figure 4:
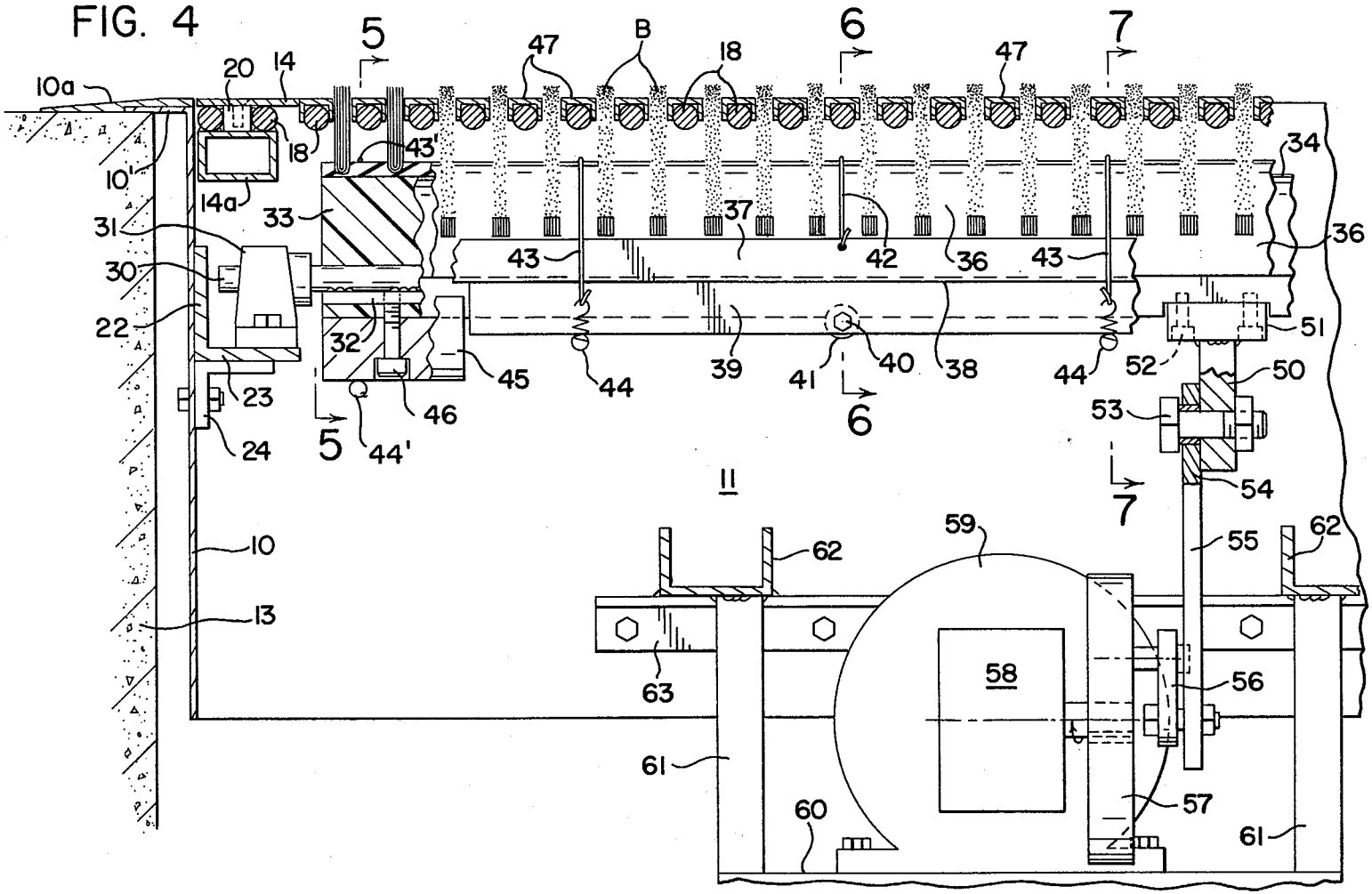
FIG. 4 is an enlarged partial sectional view on line 4—4 of FIG. 3.

As shown in FIGS. 2 and 4, the housing is designed and adapted to fit within a pit in a floor or foundation 13, with the flanges 10' and 11' and the molding strips **10*a* and 11*a* overlying and resting on top of the pit walls. The grid 12 comprises a rectangular frame having marginal horizontal side strips 14 and end strips 15 with transverse strips 16 extending between side strips 14 and parallel to end strips 15. Preferably, the top surfaces of frame strips 14, 15 and 16 are coated with non-skid material or otherwise given a non-skid surface treatment. The outer edges of the marginal strips 14 and 15 fit with a close tolerance within the molding strips 10*a* and 11*a* and the underlying side walls 10 and 11 of the housing, with the marginal frame strips normally in the same horizontal plane as the molding strips 10*a* and 11*a***.

Figure 3:
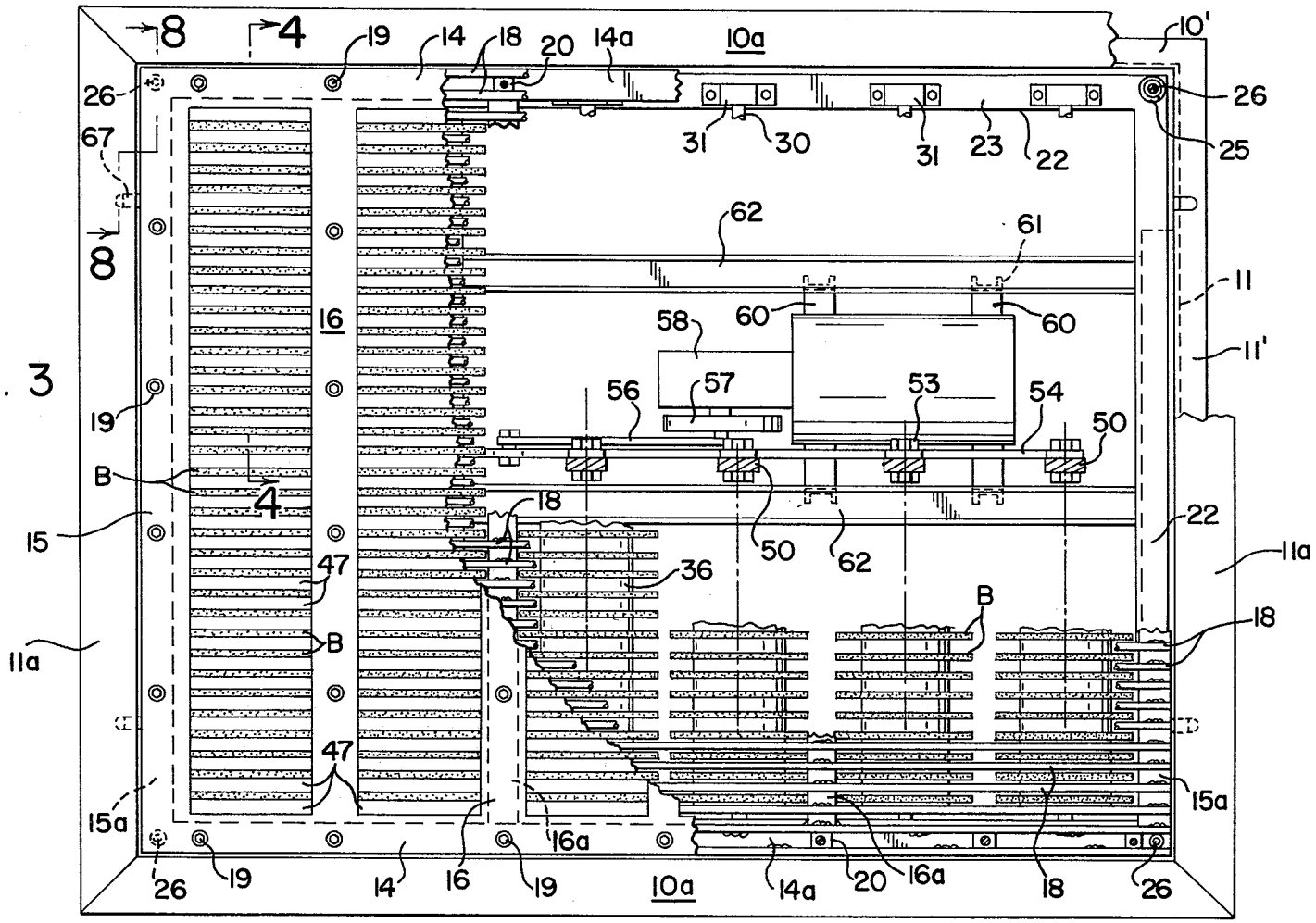
FIG. 3 is a plan view, partly broken away, as on line 3—3 of FIG. 2.

Spaced below the marginal frame strips 14 and 15 are box beams **14*a* and 15*a*. Similar box beams 16*a* are spaced below alternate transverse strips 16. Laterally spaced longitudinal grid rods 18 are welded to the box beams 14*a*, 15*a* and 16*a* and abut the undersides of the strips. As shown in FIGS. 2 and 3, the ends of the rods 18 rest on the box beams 15*a*, with intermediate portions resting on beams 16*a*. The two laterally outermost rods 18 on each side under frame strips 14 rest on beams 14*a* (FIG. 4) and are welded thereto. The strips 14, 15 and 16 are secured to the beams 14*a*, 15*a* and 16*a* by screws 19 threaded into nuts 20 secured between the rods 18**.

Angle supports 22 spaced below the box beams **14*a* have their horizontal legs 23 supported on angles 24 bolted to the side walls 10 of the housing. As shown in FIG. 8, the beams are yieldably supported on the legs 23 by helical springs 25 encircling rods 26 extending slidably through holes in the beams, the springs preferably abutting rubber blocks 27 interposed between their ends and the beams and channel legs 23, respectively. Thus, the entire grid is yieldingly supported on the angles 22** for limited downward movement.

As shown in FIG. 2, a series of longitudinally spaced shafts 30 extend transversely below the grid, and as shown in FIG. 4, each of these shafts is journaled at its ends in bearings 31 supported on the angles 22. Each of the shafts 30 is welded to the upper surface of a flat metal strip 32 extending parallel to the shaft. Between the bearings 31, the shafts 30 are each encapsulated in a molded bar 33 of elastomeric material such as polyvinyl chloride having a semi-cylindrical upper surface 34 (FIG. 6) terminating in flat undercut shoulders 35 in the plane of the axis of the shaft 30.

A flexible strip 36 of elastomeric material having the ends of parallel rows of brush bristles B molded therein is wrapped around each surface 34 with the ends of the strip inserted under the upper flanges 37 of Z-shaped strips extending along the sides of the bar 33 and having angle portions 38 engaging under the shoulders 35 and lower flanges 39 depending therefrom. The lower flanges 39 are secured by screws 40 to the ends of transverse bars 41 of elastomeric material passing under the metal strip 32.

Figure 5:
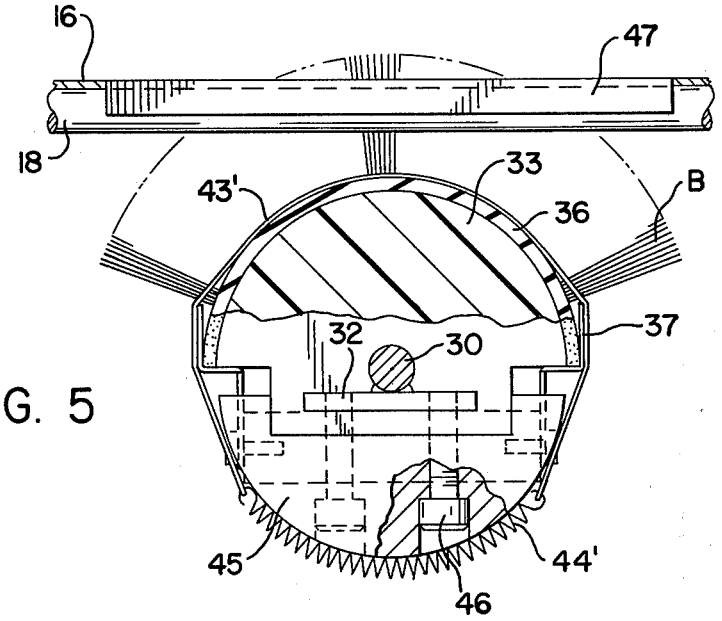
FIG. 5 is a further enlarged partial sectional view on line 5—5 of FIG. 4.
Figure 6:
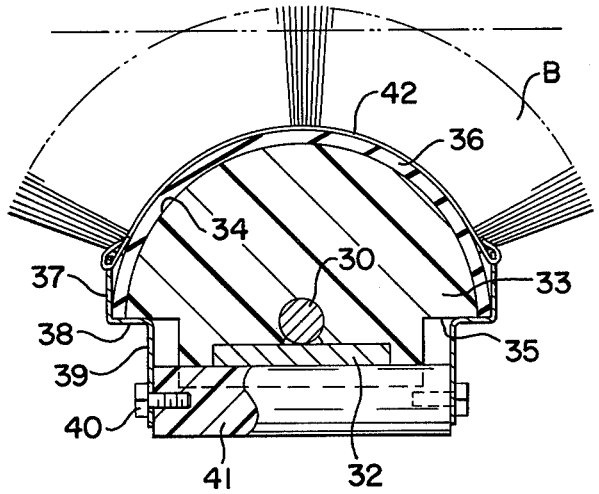
FIG. 6 is an enlarged partial sectional view on line 6—6 of FIG. 4.

Wires 42 and 43 passing between rows of bristles hold the strip 36 in convexly curved position around the molded bars 33. Each strip has wires spaced at intervals along the bar 33, and as seen in FIGS. 4 and 6, certain of the retaining wires 42 have their ends hooked in the upper flanges 37, while other wires 43 pass around the flanges 37 and have their ends hooked to a coil tension spring 44 passing under the lower flanges 39 (FIG. 7). As shown in FIGS. 4 and 5, metal counterweights 45 are attached to the ends of each molded bar 33 under the flat metal strip 32. Each counterweight has an arcuate bottom surface and is secured to the strip 32 by screw studs 46. A retaining wire 43' may be passed over strip 36 and around the flanges 37 and secured to the ends of a coil spring 44' passing under the counterweight 45.

The transversely spaced convexly curved rows of bristles on all of the bars 33 form longitudinal aligned sections of longitudinal rows extending throughout the length of the grid.

This construction and arrangement of the bristle mounting bars provides a lightweight and economical assembly which allows quick disassembly for replacing bristles by merely detaching the wires 42 and 43 and lifting off and replacing the flexible strips 36 with new strips having new bristles.

As indicated in FIG. 4, the rows of bristles B are spaced apart along the bars 33 so as to pass between the grid rods 18 with the medial portion of each row projecting tangentially above the rods between the transverse frame strips 15 and 16. Each of the rods 18 has a downwardly open metal channel 47 detachably secured on top of the rod, preferably by a suitable adhesive. The channels extend along the rods between the frame strips 15 and 16 and the upper surfaces of the channels lie in the same horizontal plane as the top surfaces of the frame strips 14, 15 and 16. The adjacent surfaces of the channel legs provide slots closely enclosing the bristles B so that a flat upper supporting surface is provided throughout the grid for supporting the shoes of a person stepping on the grid except for the narrow tangential portions of the bristles projecting therethrough.

The medial portion of each bristle mounting bar 33 has a depending actuating arm 50 having a block 51 at its upper end secured by screws 52 to the metal strip 32 extending along the base of the bar, as seen in FIGS. 4 and 7. Each arm 50 is pivotally connected by a bolt 53 to a rack bar 54 extending transversely of the bristle mounting bars (FIG. 2). A leg 55 depends from rack bar 54 and is pivotally connected to one end of a pitman arm 56 pivotally connected at its other end eccentrically of a fly wheel 57 which is driven through the gear box 58 by an electric motor 59. As shown in FIGS. 2 and 4, the motor 59 is supported in a saddle formed by transverse base channels 60 hung by bars 61 from upper longitudinal channels 62, the ends of which are supported on angles 63 bolted to the end walls 11 of the housing.

When the motor 59 is energized the rack bar 54 will reciprocate, oscillating the actuating arms 50 and the bristles 37 in opposite directions as indicated in FIG. 7, so that the projecting bristles will sweep tangentially back and forth across the shoe soles of a person stepping on the horizontal grid. The channels 47 between the rows of bristles B insure that even high narrow heels will not enter the brush slots and cause accidental catching or tilting of the shoes tending to result in instability or even injury to the person. Moreover, the tangential sweeping action of the bristles provides excellent cleaning results without presenting enough friction to the shoe soles to cause instability of the person stepping on the grid. The cooperation of the fly wheel 57 and the counterweights 45 ensures a smooth action which is not materially affected by the sudden load of a person stepping on the machine.

Energizing the motor 59 can be done in several ways. For example, in FIG. 8 a limit switch 65 in circuit with the motor is mounted on a wall 11 of the housing and has a switch arm 66 engageable with a pin 67 projecting from the grid frame through a slot 68 in the wall. Thus, when a person steps on the grid frame and compresses the springs 25, the pin will move downwardly and actuate the switch to energize the motor.

Other well known ways of energizing the motor include the use of a photocell operatively mounted at the doorway or entrance of a building where the improved shoe cleaning machine is located.

It should be apparent that an improved shoe cleaning device has been provided which accomplishes the stated objects of the present invention.

I claim:

1. A shoe cleaning machine adapted to be embedded in the floor, comprising a housing, a rectangular grid frame within the top of the housing having horizontal side strips and flat longitudinally spaced co-planar intermediate transverse strips, longitudinal rods supporting said frame strips, downwardly open transversely spaced longitudinal channels supported on said rods between said transverse strips with their webs in coplanar relation to said frame strips, longitudinal rows of brush bristles projecting between the channels and closely embraced by the legs of said channels, said rows of bristles comprising separate parallel sections extending between said transverse frame strips, said sections each comprising convexly arranged bristles projecting tangentially between said channels, and means for oscillating said bristles.

2. A shoe cleaning machine as described in claim 1, wherein said rods are supported on beam members extending around the sides and ends of the housing.

3. A shoe cleaning machine as described in claim 2, wherein said beam members are yieldably mounted on supports fixed on said housing.

4. A shoe cleaning machine as described in claim 2, wherein said parallel sections of bristles are mounted on transverse bars rotatably supported at their ends on said housing, and said oscillating means comprises means for oscillating said bars.

5. A shoe cleaning machine as described in claim 4, wherein said transverse bars have their upper surfaces convexly rounded, the parallel sections of bristles molded at their ends in normally flat flexible strips detachably wrapped around said upper surfaces, and spring tension means detachably fastening said flexible strips around said bars.

6. A shoe cleaning machine as described in claim 5, wherein said bars and said strips are molded elastomeric material.

7. A shoe cleaning machine as described in claim 1, wherein said parallel sections of bristles are mounted on transverse bars rotatably supported at their ends on said housing, and said oscillating means comprises means for oscillating said bars.

8. A shoe cleaning machine as described in claim 7, wherein said transverse bars have their upper surfaces convexly rounded, and the parallel sections of bristles are molded at their ends in normally flat flexible strips wrapped around said upper surfaces.

9. A shoe cleaning machine as described in claim 8, wherein spring tension means are provided for detachably fastening said flexible strips around said bars.

10. A shoe cleaning machine as described in claim 9, wherein said bars and said strips are molded elastomeric material.

11. A shoe cleaning machine as described in claim 1, wherein the upper surfaces of the grid frame are non-skid surfaces.

* * * * *